US010731654B2

(12) United States Patent
Zielberg et al.

(10) Patent No.: US 10,731,654 B2
(45) Date of Patent: Aug. 4, 2020

(54) COOLANT PUMP FOR AN INTERNAL COMBUSTION ENGINE

(71) Applicant: PIERBURG GMBH, Neuss (DE)

(72) Inventors: Stephan Zielberg, Bochum (DE); Michael-Thomas Benra, Castrop-Rauxel (DE); Andreas Burger, Krefeld (DE); Martin Nowak, Leverkusen (DE); Stefan Rothgang, Rheinberg (DE)

(73) Assignee: PIERBURG GMBH, Neuss (DE)

( * ) Notice: Subject to any disclaimer, the term of this patent is extended or adjusted under 35 U.S.C. 154(b) by 94 days.

(21) Appl. No.: 15/772,814

(22) PCT Filed: Oct. 19, 2016

(86) PCT No.: PCT/EP2016/075082

§ 371 (c)(1),
(2) Date: May 2, 2018

(87) PCT Pub. No.: WO2017/076649

PCT Pub. Date: May 11, 2017

(65) Prior Publication Data

US 2018/0320693 A1 Nov. 8, 2018

(30) Foreign Application Priority Data

Nov. 6, 2015 (DE) ..... 10 2015 119 095

(51) Int. Cl.
*F01P 5/10* (2006.01)
*F04D 15/00* (2006.01)
*F04D 13/12* (2006.01)

(52) U.S. Cl.
CPC ..... *F04D 15/0038* (2013.01); *F01P 5/10* (2013.01); *F04D 13/12* (2013.01); *F01P 2005/105* (2013.01); *F05D 2270/64* (2013.01)

(58) Field of Classification Search
None
See application file for complete search history.

(56) References Cited

U.S. PATENT DOCUMENTS 2,946,288 A * 7/1960 Carter, Jr. ..... F04D 15/0055 415/48
3,081,252 A 3/1963 Preiser et al.
(Continued)

FOREIGN PATENT DOCUMENTS

CN 103423170 A 12/2013
CN 203516133 U 4/2014
(Continued)

*Primary Examiner* — Aaron R Eastman
*Assistant Examiner* — Theodore C Ribadeneyra
(74) *Attorney, Agent, or Firm* — Norman B. Thot

(57) ABSTRACT

A coolant pump for an internal combustion engine. The coolant pump includes a delivery duct, a drive shaft, a coolant pump impeller arranged on the drive shaft to rotate therewith and to convey a coolant, and an adjustable control slide which controls a throughflow cross-section of an annular gap arranged between an outlet of the coolant pump impeller and the surrounding delivery duct. The control slide comprises a first pressure chamber arranged on a side of the control slide facing away from the coolant pump impeller and a second pressure chamber arranged opposite thereto. A control pump includes a control pump impeller arranged at the drive shaft to rotate therewith. A connecting duct fluidically connects the flow duct to the second pressure chamber. A pressure duct fluidically connects the flow duct outlet to the first pressure chamber. A valve opens and closes a throughflow cross-section of the pressure duct.

10 Claims, 2 Drawing Sheets

(56) References Cited

U.S. PATENT DOCUMENTS

| | | | | |
|---|---|---|---|---|
| 3,204,863 | A | 9/1965 | Hausammann | |
| 3,918,831 | A * | 11/1975 | Grennan | F04D 15/0038 415/131 |
| 4,346,944 | A * | 8/1982 | Leiber | B60T 8/3635 303/115.4 |
| 4,568,130 | A * | 2/1986 | Leiber | B60T 8/1764 303/113.4 |
| 4,584,905 | A * | 4/1986 | Eschrich | F16D 48/066 477/155 |
| 5,147,114 | A * | 9/1992 | Hommen | B60T 8/00 303/15 |
| 5,281,088 | A | 1/1994 | Brandt | |
| 5,800,120 | A * | 9/1998 | Ramsay | F04D 15/0038 415/129 |
| 6,551,058 | B2 * | 4/2003 | Nowack | F04D 29/2261 415/131 |
| 8,608,452 | B2 * | 12/2013 | Draheim | F04D 15/0038 415/131 |
| 10,094,454 | B2 * | 10/2018 | Russalian | F16H 19/02 |
| 2002/0079386 | A1 * | 6/2002 | Bonse | F02M 61/10 239/533.9 |
| 2003/0230342 | A1 * | 12/2003 | Skoff | B60C 23/003 137/224 |
| 2006/0175825 | A1 * | 8/2006 | Reichler | B05B 5/1625 285/47 |
| 2013/0309103 | A1 | 11/2013 | Markus Popp et al. | |
| 2014/0050562 | A1 | 2/2014 | Welte et al. | |
| 2015/0098804 | A1 | 4/2015 | Russalian et al. | |

FOREIGN PATENT DOCUMENTS

| | | | |
|---|---|---|---|
| DE | 15 28 718 | B2 | 3/1976 |
| DE | 692 23 216 | T2 | 3/1998 |
| DE | 10 2010 044 167 | A1 | 5/2012 |
| DE | 10 2012 207 387 | A1 | 1/2013 |
| DE | 10 2013 011 209 | B3 | 1/2014 |
| DE | 10 2012 214 503 | A1 | 2/2014 |
| DE | 10 2013 111 939 | B3 | 10/2014 |
| EP | 0 142 219 | A1 | 5/1985 |
| EP | 2 169 235 | A3 | 6/2012 |
| JP | 51-119604 | | 9/1976 |
| JP | 2005-299552 | A | 10/2005 |
| WO | WO 2005/015024 | A1 | 2/2005 |

* cited by examiner

COOLANT PUMP FOR AN INTERNAL COMBUSTION ENGINE

CROSS REFERENCE TO PRIOR APPLICATIONS

This application is a U.S. National Phase application under 35 U.S.C. § 371 of International Application No. PCT/EP2016/075082, filed on Oct. 19, 2016 and which claims benefit to German Patent Application No. 10 2015 119 095.8, filed on Nov. 6, 2015. The International Application was published in German on May 11, 2017 as WO 2017/076649 A1 under PCT Article 21(2).

FIELD

The present invention relates to a coolant pump for an internal combustion engine having a drive shaft, a coolant pump impeller which is arranged at the drive shaft at least in a rotationally fixed manner and via which coolant is adapted to be delivered, an adjustable control slide via which a free cross-section of an annular gap between an outlet of the coolant pump impeller and the surrounding delivery duct is controllable, a control pump having a control pump impeller which is arranged at the drive shaft at least in a rotationally fixed manner, a flow duct of the control pump in which a pressure is adapted to be generated by rotation of the control pump impeller, a pressure duct via which an outlet of the flow duct is adapted to be fluidically connected to a first pressure chamber of the control slide, which is formed at the axial side of the control slide facing away from the coolant pump impeller, and a valve via which a flow cross-section of the pressure duct is adapted be closed and opened.

BACKGROUND

Such coolant pumps in an internal combustion engine serve to control the flow rate of the delivered coolant to prevent the internal combustion engine from overheating. These pumps are in most cases driven via a belt or a chain drive so that the coolant pump impeller is driven at the speed of the crankshaft or at a fixed ratio to the speed of the crankshaft.

In modern internal combustion engines, the delivered coolant flow must be matched with the coolant demand of the internal combustion engine or the motor vehicle. The cold running phase of the engine should in particular be reduced to prevent increased pollutant emissions and to reduce fuel consumption. This is realized, inter alia, by restricting or completely switching off the coolant flow during this phase.

Various pump designs for controlling coolant flow rate are known. Besides electrically driven coolant pumps, pumps are known which can be coupled to or decoupled from their drive units via couplings, in particular hydrodynamic couplings. A particularly inexpensive and simple manner of controlling the delivered coolant flow is the use of an axially movable control slide which is pushed across the coolant pump impeller so that, for reducing the coolant flow, the pump does not deliver into the surrounding delivery duct but against the closed slide.

The control of this slide is also performed in different ways. Besides a purely electric adjustment, a hydraulic adjustment of the slides has in particular proved successful. A hydraulic displacement is in most cases carried out via an annular piston chamber which is filled with a hydraulic fluid and whose piston is connected to the slide to move the slide across the impeller during filling of the chamber. The slide is returned by opening the piston chamber towards an outlet, in most cases via a magnetic valve, as well as via a spring action providing the force for returning the slide.

For the coolant flow required for moving the slide not to be supplied via additional delivery units, such as additional piston/cylinder units, or for other hydraulic fluids not to be compressed for operating purposes, mechanically controllable coolant pumps are known on whose drive shaft a second delivery wheel is arranged via which the pressure for adjusting the slide is provided. These pumps are designed, for example, as side channel pumps or as servo pumps.

A coolant means having a side channel pump acting as a secondary pump is described in DE 10 2012 207 387 A1. In this pump, via a ⅔-way valve, in a first position, a discharge side of the secondary pump is closed and a suction side of the pump is connected to the coolant circuit and the slide, and in a second position, the discharge side is connected to the slide and the suction side is connected to the coolant circuit. A spring is used to return the slide, which spring may be omitted when the pump is to be reset by the negative pressure produced at the suction connection. A detailed duct and flow routing is not described. The schematically shown flow routing is only realizable in modern internal combustion engines with an increased technical effort and with a larger installation space. It is also doubtful whether the force acting on the slide due to the negative pressure is sufficiently large to overcome the frictional forces acting during adjustment.

SUMMARY

An aspect of the present invention is to provide a coolant pump for an internal combustion engine where a return of the slide into its position for providing a maximum delivery rate of the coolant pump both during control of the pump in normal operation and during an emergency operation, i.e., when the electric system and thus the magnetic valve fail, can be provided without a pressure spring. An additional aspect of the present invention is to provide a coolant pump whose duct and coolant routing can be realized in the space available in modern internal combustion engines. An aspect of the present invention is in particular to arrange the pump as a plug pump in a corresponding recess in the crankcase.

In an embodiment, the present invention provides a coolant pump for an internal combustion engine. The coolant pump includes a delivery duct, a drive shaft, and a coolant pump impeller arranged on the drive shaft so as to rotate jointly therewith. The coolant pump impeller is configured to convey a coolant. A control slide is configured to be adjustable so as to control a throughflow cross-section of an annular gap arranged between an outlet of the coolant pump impeller and the surrounding delivery duct. The control slide comprises a first pressure chamber arranged on a first axial side of the control slide facing away from the coolant pump impeller and a second pressure chamber arranged on a second axial side of the control slide facing the coolant pump impeller. A control pump comprises a control pump impeller which is arranged at the drive shaft so as to rotate jointly therewith. A flow duct is configured so that a pressure can be generated by a rotation of the control pump impeller. The flow duct comprises an outlet and is fluidically connected via a connecting duct to the second pressure chamber. A pressure duct is configured to fluidically connect the outlet of the flow duct to the first pressure chamber of the control slide. A valve is configured to open and to close a through-flow cross-section of the pressure duct.

BRIEF DESCRIPTION OF THE DRAWINGS

The present invention is described in greater detail below on the basis of embodiments and of the drawings in which.

DETAILED DESCRIPTION

Figure 1:
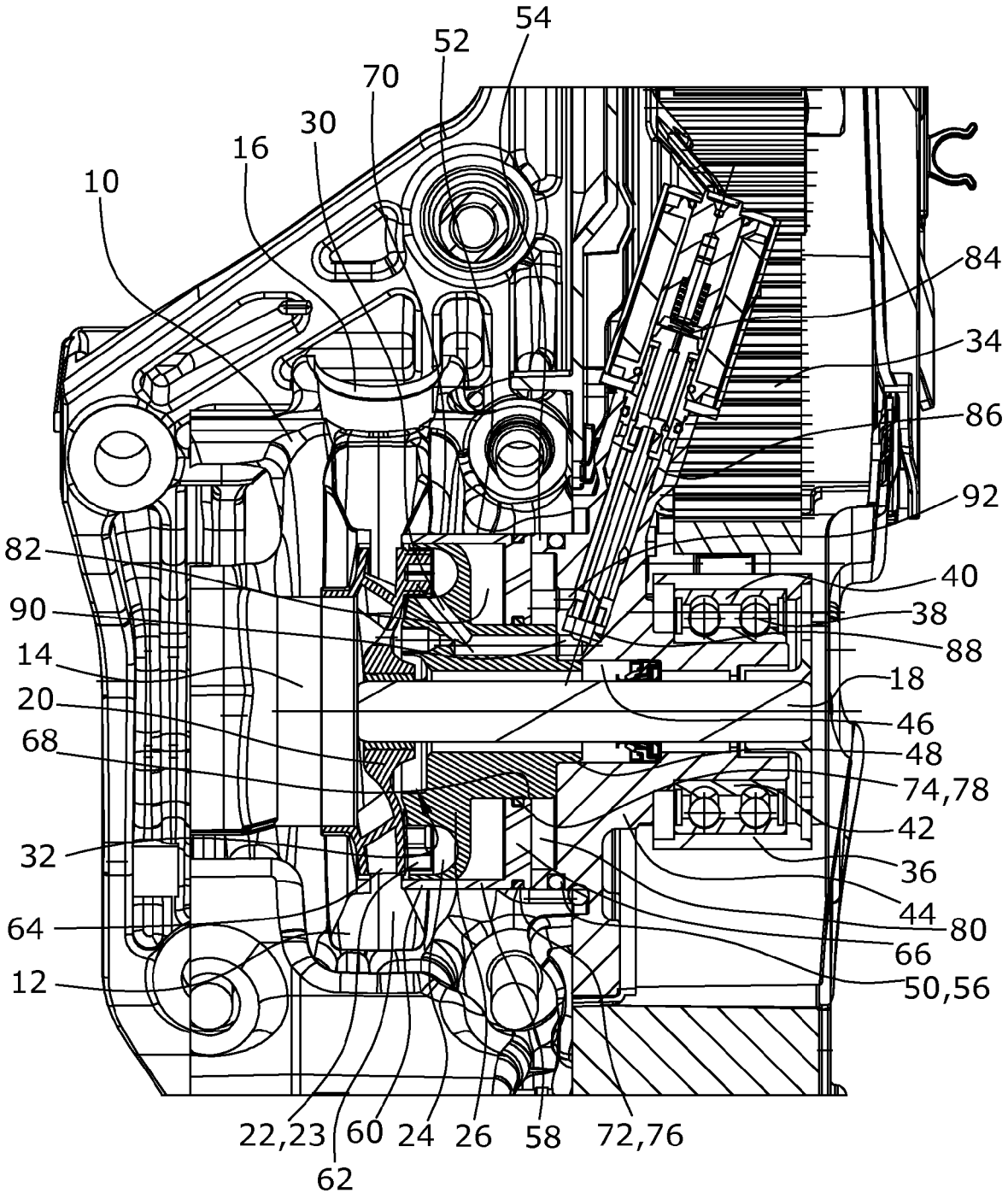
FIG. 1 shows a cross-sectional side view of a coolant pump according to the present invention.
Figure 2:
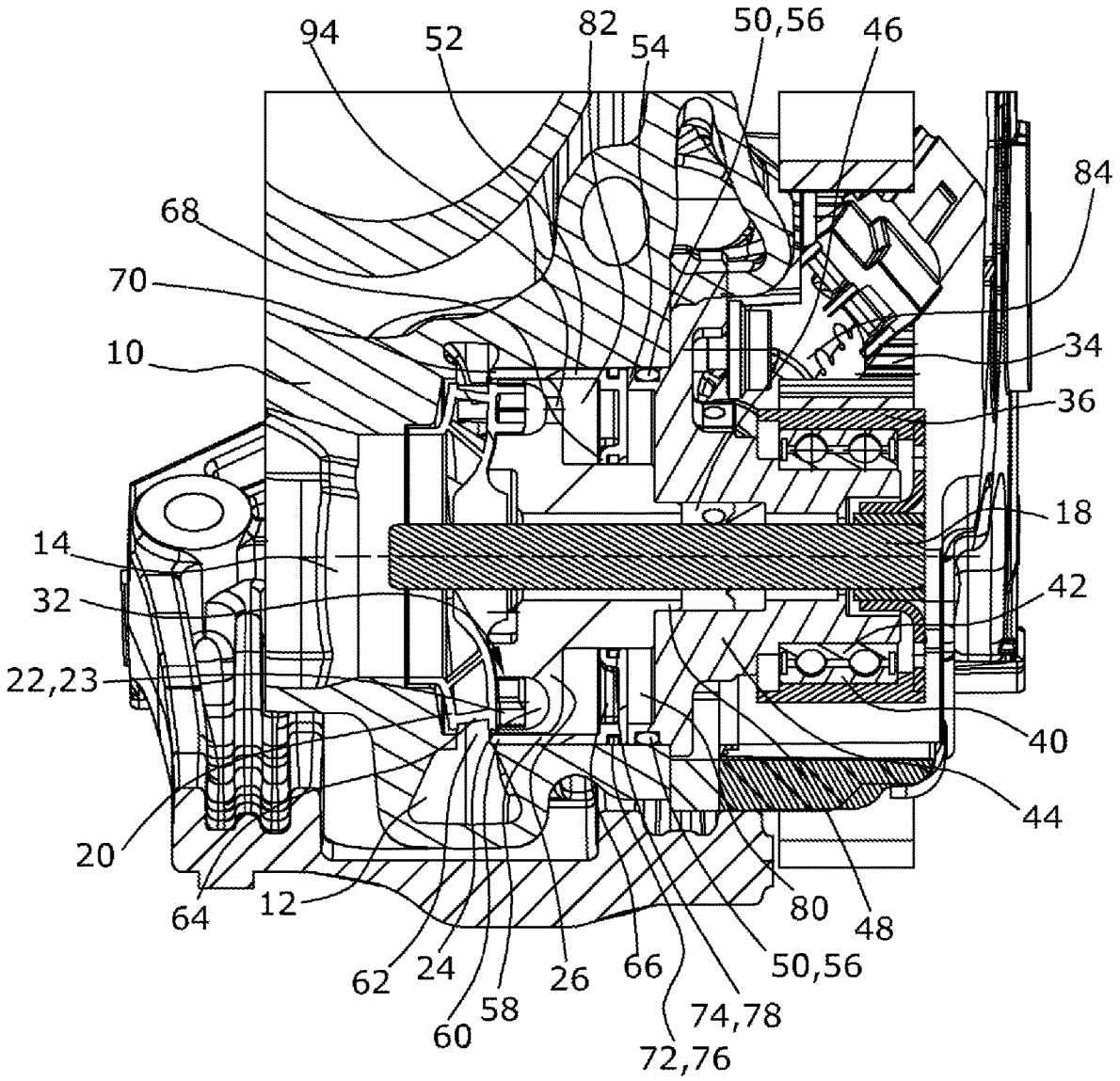
FIG. 2 shows a cross-sectional side view of the coolant pump according to the present invention rotated with respect to FIG. 1.

Because the flow duct is fluidically connected via a connecting duct to a second pressure chamber of the control slide, which is formed at the axial side of the control slide facing the coolant pump impeller, if the valve fails resulting in a closed connection to the first pressure chamber, a pressure is built up on the opposite side of the control slide via which the control slide is reliably pushed into its position for clearing the coolant pump impeller without a return spring being required. In the case of a failure of the electrical supply, an emergency operation position of the control slide is thus provided in which a maximum coolant delivery to the internal combustion engine is carried out and thus an overheating of the internal combustion engine is avoided.

In an embodiment of the present invention, the valve can, for example, be a ⅗-way valve which is easy to drive and which requires only little space so that integration into the housing of the coolant pump is possible. By controlling the valve, the valve can be moved into intermediate positions which, depending on the open cross-section, also result in a complete position control of the control slide.

In an embodiment of the present invention, the control pump impeller can, for example, be integrally formed with the coolant pump impeller. Both impellers can accordingly be manufactured and assembled in a single manufacturing step. The required axial installation space is also reduced.

In an embodiment of the present invention, the flow duct of the control pump can, for example, be arranged in a first fixed housing part on whose side axially opposite to the flow duct the second pressure chamber is formed. This housing part therefore also serves as an axial delimitation of the second pressure part and a flow housing of the control pump. This housing part may also serve as a sliding surface and thus as a guide for the control slide.

In an embodiment of the present invention, the connecting duct can, for example, be formed in the fixed housing part which comprises the flow duct. This can be realized by forming a simple bore so that no additional lines between the flow duct and the second pressure chamber need to be installed. The manufacture and assembly effort for the coolant pump as well as its space requirement are accordingly reduced.

A reliable function in the control of the slide is realized when the connecting duct extends from an area of an inlet of the control pump into the second pressure chamber. Due to this arrangement, the pressure in the second pressure chamber builds up only when the valve is closed, that is, when a delivery pressure of the pump also occurs at the inlet due to the closing of the outlet. Only the low pressure otherwise prevails in the second pressure chamber in the area of the inlet of the control pump.

In an embodiment of the present invention, the control pump impeller can, for example, be arranged on the rear side of the coolant pump impeller axially between the second pressure chamber and the coolant pump impeller. Besides the axially short design which is provided by this arrangement, short flow paths for connecting the pressure chambers to the delivery duct and/or the impeller of the control pump are thus created.

In an embodiment of the present invention, the control pump can, for example, be a side channel pump so that the delivery duct can also be arranged axially opposite to the impeller. It is in particular suitable for generating high delivery pressures at small volume flows.

In an embodiment of the present invention, the pressure duct can, for example, extend from the outlet of the control pump through the first housing part and a second housing part to the first pressure chamber, wherein the throughflow cross-section governed by the valve is formed in the second housing part. This design allows for creation of a very compact coolant pump without any additional connecting lines.

In an embodiment of the present invention, the pressure duct can, for example, be formed in the first housing part radially inside the control slide, and the first housing part can, for example, delimit the two pressure chambers radially inwards. The first housing part can thus at the same time serve as an internal guide of the control slide. The ducts can be very short, whereby the response time of the control is reduced.

A coolant pump for an internal combustion engine is thus provided where the control slide is purely hydraulically operated both during normal operation and in the case of an emergency operation so that no additional components, such as springs and the like, are required to provide an adequate delivery of coolant to prevent the internal combustion engine from overheating. This pump also only requires little installation space. The coolant pump according to the present invention is also easy and inexpensive to manufacture and to assemble.

An exemplary embodiment of the coolant pump according to the present invention for an internal combustion engine is illustrated in the drawings and is described below.

The coolant pump according to the present invention is composed of an outer housing 10 in which a spiral delivery duct 12 is formed into which a coolant is sucked via an axial pump inlet 14 that is also formed in the outer housing 10, which coolant is delivered via the delivery duct 12 to a tangential pump outlet 16 formed in the outer housing 10 and into a cooling circuit of the internal combustion engine.

For this purpose, radially inside the delivery duct 12, a coolant pump impeller 20 is fastened to a drive shaft 18, which coolant pump impeller 20 is configured as a radial pump wheel, the rotation of which effects the delivery of the coolant in the delivery duct 12. On the side of the coolant pump impeller 20 axially opposite to the pump inlet 14, a control pump impeller 22 is formed which is rotated together with the coolant pump impeller 20. The control pump impeller 22 comprises blades 23 which are arranged axially opposite to a flow duct 24 configured as a side channel formed in a first inner housing part 26. In the first housing part 26, an inlet and an outlet 30 are formed so that the control pump impeller 22 together with the flow duct 24 forms a control pump 32 via which the pressure of the coolant is increased from the inlet to the outlet 30.

The coolant pump impeller 20 and the control pump impeller 22 are driven via a belt 34 which engages with a belt pulley 36 that is fastened to the axial end of the drive shaft 18 opposite to the coolant pump impeller 20. Driving via a chain drive is also possible. The belt pulley 36 is supported via a two-row ball bearing 38 whose outer race 40 is pressed to the belt pulley 36 and whose inner race 42 is pressed to a second inner housing part 44. The second inner housing part 44 comprises an inner axial through-going opening 46 into which an annular projection 48 of the first inner housing part 26 projects, via which the first inner housing part 26 is fastened to the second inner housing part 44. The second inner housing part 44 is fastened to the outer housing 10 using a seal 50 as an intermediate layer. For this purpose, the outer housing 10 comprises an accommodation opening 52 at its axial end opposite to the pump inlet 14, into which accommodation opening 52 an annular projection 54 of the second inner housing part 44 projects, at whose circumferential wall a groove 56 is formed in which the seal 50 is arranged.

The annular projection 54 at the same time serves as a rear stopper for a control slide 58 whose cylindrical circumferential wall 60 can be pushed across the coolant pump impeller 20 so that a free cross-section of an annular gap 62 between an outlet 64 of the coolant pump impeller 20 and the delivery duct 12 is controlled. The coolant flow delivered through the coolant circuit is thus controlled depending on the position of the control slide 58.

Besides the cylindrical circumferential wall 60, the control slide 58 also comprises a bottom plate 66 having an inner opening 68 from whose outer circumference the cylindrical circumferential wall 60 axially extends through an annular gap 70 between the first inner housing part 26 and the outer housing 10 towards the axially adjoining annular gap 62. At each of the inner circumference and at the outer circumference of the bottom plate 66, a radial groove 72, 74 is formed in which a respective piston ring 76, 78 is arranged via which the control slide 58 is slidingly supported in the radially inner area on the first inner housing part 26 and in the radially outer area in the accommodation opening 52 of the outer housing 10.

According to the present invention, on the side of the control slide 58 facing away from the coolant pump impeller 20, a first pressure chamber 80 is located which is axially delimited by the second inner housing part 44 and the bottom plate 66 of the control slide 58, which is delimited radially outwards by the outer housing 10 and/or the annular projection 54 of the second inner housing part 44, and which is delimited radially inwards by first inner housing part 26. On the side of the bottom plate 66 facing the coolant pump impeller 20, a second pressure chamber 82 is formed which is axially delimited by the bottom plate 66 and the first inner housing part 26, which is delimited radially outwards by the cylindrical circumferential wall 60 of the control slide 58, and which is delimited radially inwards by the first inner housing part 26. The cylindrical circumferential wall 60 of the control slide 58 is pushed into the annular gap 62 or is removed from the annular gap 62 depending on the pressure difference prevailing at the bottom plate 66 of the control slide 58, the first pressure chamber 80, and in the second pressure chamber 82.

The pressure difference required for this purpose is generated by the control pump 32 and is supplied to the respective first pressure chamber 80 and second pressure chamber 82 by a valve 84 which is configured as a 3/2-way magnetic valve. For this purpose, in the second inner housing part 44, an accommodation opening 86 for the valve 84 is formed via which a throughflow cross-section 90 of a pressure duct 92 is controlled depending on the position of its closing body 88. The pressure duct 92 first extends from the outlet 30 of the flow duct 24 of the control pump 32 into a radially inner area of the first inner housing part 26, and from there axially into the second inner housing part 44 in which the controllable throughflow cross-section 90 of the pressure duct 92 is formed which is adapted to be closed and opened by the closing body 88 of the magnetic valve 84. From there, the controllable throughflow cross-section 90 the pressure duct 92 extends further up to the first pressure chamber 80. The second pressure chamber 82 is connected to the flow duct 24 via a connecting duct 94 formed in the first inner housing part 26, wherein the connecting duct 94 is configured as a bore which extends from an area of the inlet from the flow duct 24 directly into the second pressure chamber 82. A third flow connection (not shown in the drawings) of the control valve leads to the suction side of the coolant pump.

If the coolant pump is to deliver a maximum coolant flow during operation, the annular gap 62 at the outlet 64 of the coolant pump impeller 20 is completely opened by not applying current to the magnetic valve 84, whereby the closing body 88 is pressed by a spring force into its position for closing the throughflow cross-section 90 of the of the pressure duct 92. As a result, no pressure is built up by the coolant in the first pressure chamber 80, but the coolant present in the first pressure chamber 80 can flow off to the axial pump inlet 14 of the coolant pump via the other flow connection (not shown in the drawings) of the magnetic valve 84 which is open in this state. In this state, the control pump 32 instead delivers against the closed throughflow cross-section 90, whereby an increased pressure builds up in flow duct 24, which also acts in the area of the inlet of the control pump and accordingly also builds up in the second pressure chamber 84. This increased pressure in the second pressure chamber 82 results in a pressure difference at the bottom plate 66 of the control slide 58, which leads to the control slide 58 being moved into its position in which the annular gap 62 is opened and thus a maximum delivery of the coolant pump provided. Accordingly, in the case of failure of the power supply of the magnetic valve 84, the control slide 58 assumes the same position so that even in this emergency operating state, a maximum delivery of the coolant pump is provided without a return spring or any other non-hydraulic power being necessary. An excessive increase of the pressure in the second pressure chamber 82 is avoided, inter alia, due to a leakage via the annular gap 70 between the first inner housing part 26 and the cylindrical circumferential wall 60 so that the coolant additionally delivered by the control pump 32 is also used for delivery into the cooling circuit. The coolant from the first pressure chamber 80 can flow out via a return duct (not shown in the drawings) which extends from the magnetic valve 84 through the second inner housing part 44 and then extends along the drive shaft 18 inside the first inner housing part 26 and via a bore in the coolant pump impeller 20 to the pump inlet 14 of the coolant pump.

If the engine control requires a reduced coolant flow to the cooling circuit, as is the case, for example, during the warm-up of the internal combustion engine after a cold start, current is applied to the magnetic valve 84, whereby the closing body 88 opens the throughflow cross-section 90 of the pressure duct 92. The pressure produced at the outlet 30 of the control pump 32 is accordingly also generated in the pressure duct 92 and in the first pressure chamber 80, while at the same time the pressure in the second pressure chamber 82 decreases since a reduced pressure occurs due to the intake of the coolant in the area of the inlet. The coolant present in the second pressure chamber 82 is initially also extracted. In this state, a pressure difference is accordingly again present at the bottom plate 66 of the control slide 58 which results in the control slide 58 being moved into the annular gap 62 and thus the coolant flow in the cooling circuit being interrupted. In the case of an increased pressure buildup in the first pressure chamber 80, the pressure in the flow duct 24 and in the second pressure chamber 82 also increases after a while, but this does not lead to a return movement since the leakage from the second pressure chamber 82 is larger than that from the first pressure chamber 80 and, for adjustment purposes, a frictional force would additionally need to be overcome. The control slide 58 accordingly remains in the desired position without an excessive pressure increase.

If a controllable magnetic valve 84 is used, it is also possible to move the valve 84 into intermediate positions whereby, for each position of the control slide 58, an equilibrium of forces is attainable so that a complete control of the throughflow cross-section of the annular gap 62 is provided.

The described control pump has an extremely compact design but is easy and inexpensive to manufacture and assemble. Additional lines for a hydraulic connection of the control pump to the pressure chambers of the control slide can be omitted since these chambers can be configured, over very short distances, as simple bores in the two inner housing parts. Adjustment of the control slide is exclusively effected via the hydraulic forces prevailing in the two pressure chambers so that additional components, such as return springs, are not required. A reliable emergency function is nonetheless provided since in the case of failure of current application, a pressure difference across the control slide invariably occurs, which moves the latter into its position for opening the annular gap. The force required for moving the control slide into the position for closing the annular gap is also reduced due to omission of the return spring so that a more rapid adjustment with smaller cross-sections is possible.

It should be appreciated that the scope of protection of the present invention is not limited to the described embodiment. Other split designs of the housing or the use of a different valve or a differently configured control pump are in particular conceivable. The duct routing or the delimitation of the pressure chambers can also be changed without departing from the present invention. A two-piece configuration of the two pump impellers is also, for example, conceivable. Reference should also be had to the appended claims.

What is claimed is:

1. A coolant pump for an internal combustion engine, the coolant pump comprising:

a delivery duct;

a drive shaft;

a coolant pump impeller arranged on the drive shaft so as to rotate jointly therewith, the coolant pump impeller being configured to convey a coolant;

a control slide which is configured to be adjustable so as to control a throughflow cross-section of an annular gap arranged between an outlet of the coolant pump impeller and the surrounding delivery duct, the control slide comprising a first pressure chamber arranged to directly abut on a first axial side of the control slide facing away from the coolant pump impeller and a second pressure chamber arranged to directly abut on a second axial side of the control slide facing the coolant pump impeller;

a connecting duct;

a control pump comprising a control pump impeller which is arranged at the drive shaft so as to rotate jointly therewith, and a flow duct which is configured so that a pressure can be generated by a rotation of the control pump impeller, the flow duct comprising an outlet and being fluidically connected via the connecting duct to the second pressure chamber;

a pressure duct configured to fluidically connect the outlet of the flow duct to the first pressure chamber of the control slide; and a valve configured to open and to close a throughflow cross-section of the pressure duct.

2. The coolant pump as recited in claim 1, wherein the valve is a 3/2-way magnetic valve.

3. The coolant pump as recited in claim 1, wherein the control pump impeller is integrally formed with the coolant pump impeller.

4. The coolant pump as recited in claim 1, further comprising:

a first housing part configured to be fixed, wherein, the flow duct of the control pump is arranged in the first housing part, and the second pressure chamber is arranged on a side of the first housing part which is axially opposite to the flow duct.

5. The coolant pump as recited in claim 4, wherein the connecting duct is arranged in the first housing part.

6. The coolant pump as recited in claim 4, further comprising:

a second housing part, wherein, the pressure duct is further configured to extend from the outlet of the flow duct of the control pump through the first housing part and the second housing part into the first pressure chamber, and the throughflow cross-section which is opened and closed by the valve is arranged in the second housing part.

7. The coolant pump as recited in claim 6, wherein, the pressure duct in the first housing part is formed radially inside the control slide, and the first housing part delimits the first pressure chamber and the second pressure chamber radially inwards.

8. The coolant pump as recited in claim 1, wherein, the control pump further comprises an inlet, and the connecting duct is arranged to extend from an area of the inlet of the control pump into the second pressure chamber.

9. The coolant pump as recited in claim 1, wherein, the coolant pump impeller comprises a rear side, and the control pump impeller is arranged on the rear side of the coolant pump impeller axially between the second pressure chamber and the coolant pump impeller.

10. The coolant pump as recited in claim 1, wherein the control pump is a side channel pump.

* * * * *